US005127359A

United States Patent [19]

Kannari et al.

[11] Patent Number: 5,127,359

[45] Date of Patent: Jul. 7, 1992

[54] HOLDING APPARATUS FOR WORK TO BE COATED

[75] Inventors: Shoji Kannari; Hideki Imai, both of Hiroshima, Japan

[73] Assignee: Nishikawa Kasei Co., Ltd., Hiroshima, Japan

[21] Appl. No.: 585,681

[22] Filed: Sep. 20, 1990

[30] Foreign Application Priority Data

Nov. 24, 1989 [JP] Japan ..... 1-303259

[51] Int. Cl.[5] ..... B05C 11/02; B05C 13/02

[52] U.S. Cl. ..... 118/56; 118/500; 118/320; 74/89.21; 474/101

[58] Field of Search ..... 118/56, 500, 320; 74/89.21, 108; 474/101, 108

[56] References Cited

U.S. PATENT DOCUMENTS 907,365 12/1908 Huebner ..... 118/56
2,658,008 11/1953 Williams et al. ..... 118/56
2,936,639 5/1960 Philippi ..... 74/108
3,191,574 6/1965 Robertson ..... 118/320
4,874,639 10/1989 Matsui et al. ..... 118/56

*Primary Examiner*—W. Gary Jones
*Assistant Examiner*—Brenda Lamb
*Attorney, Agent, or Firm*—Wegner, Cantor, Mueller & Player

[57] ABSTRACT

A work holding apparatus for holding a work to be coated such as a bumper for an automobile while rotating the same is disclosed. The work holding apparatus includes a frame mounted for rotation on a support member, a work holding member mounted on the frame by means of a support bar extending perpendicularly to the longitudinal direction of a work, and a drive mechanism for rotating the frame. An axis of rotation of the frame is disposed substantially at a central position of a work held on the work holding member along a width of the work in a direction perpendicular to the longitudinal direction of the work.

4 Claims, 7 Drawing Sheets

HOLDING APPARATUS FOR WORK TO BE COATED

BACKGROUND OF THE INVENTION

This invention relates to a holding apparatus for a work to be coated such as a bumper for an automobile while rotating the same.

In order to provide high grade feeling to an automobile, a degree of coating of a body of the automobile is a very important factor, and various coating techniques have been developed to increase high grade feeling together with improvement in efficiency of coating by individual automobile makers. Also for a bumper, a collapsible urethane bumper is employed in place of a conventional bumper made of sheet metal, and coating is applied to such urethane bumper to increase the high grade feeling of the automobile. A coating process of the urethane bumper generally includes a washing step, a masking step, an undercoating and drying step, and a final coating and drying step.

In order to maintain a quality of coating, it is important to minimize causes of failure in coating. One of causes of failure in coating is a sagging of paint which takes place when a vertical face or an inclined face of a work is coated. As one of causes of such sagging, the thickness of a film of paint is excessively great or the viscosity of paint is excessively low, and if part of paint flows down over several millimeters, then the film of the paint will be swollen and form a sagging mark at a location at which such flow of the paint stops. As countermeasures for preventing the sagging of paint, various methods may be available including, for example, to decrease the thickness of a film of paint, to increase the viscosity of paint and to accelerate drying of paint. Also rotating a work for a predetermined period of time immediately after coating of the work is an effective method for preventing the sagging of paint.

For example, U.S. Pat. No. 4,874,639 discloses, under the title of coating method and apparatus on a coating line, a technique of rotating a body of an automobile while transporting the automobile body by means of a transport truck to dry coated paint on the automobile body. The coating method and apparatus disclosed in the patent, however, is suitably applied to a large size work such as a body of an automobile and is great in size and complicated in construction. Accordingly, it is difficult to apply the coating method and apparatus to coating of an elongated work such as a bumper or an air spoiler.

SUMMARY OF THE INVENTION

Accordingly, it is an object of the present invention to provide a holding apparatus for a work to be coated which can hold, with a simple construction, an elongated work such as a bumper while automatically rotating the work during drying of a coating.

In accordance with an aspect of the present invention, there is provided a work holding apparatus for holding a work thereon while rotating the same after completion of coating, comprising a first support member; a frame mounted for rotation on the first support member; a second support member mounted uprightly substantially at a central portion of the frame; a work holding member removably mounted on the second support member; an axis of rotation of the frame being provided substantially at a center of a width of a work held on the work holding member along a direction perpendicular to the longitudinal direction of the work; and driving means for rotating the frame.

The work is a bumper, for example, and the frame has a substantially C-shaped profile. Then, the bumper is held on the work holding member such that a longitudinal outer face thereof may be positioned remote from the frame. Preferably, the second support member is mounted for rotation substantially at a central portion of the frame in the longitudinal direction, and the work holding apparatus further comprises locking means for locking the second support member at a plurality of predetermined angular positions with respect to the frame.

The above and other objects, features and advantages of the present invention and the manner of realizing them will become more apparent, and the invention itself will best be understood, from a study of the following description and appended claims with reference had to the attached drawings showing some preferred embodiments of the invention.

DESCRIPTION OF THE PREFERRED EMBODIMENTS

In the following, embodiments of the present invention will be described in detail with reference to the drawings.

Figure 1:
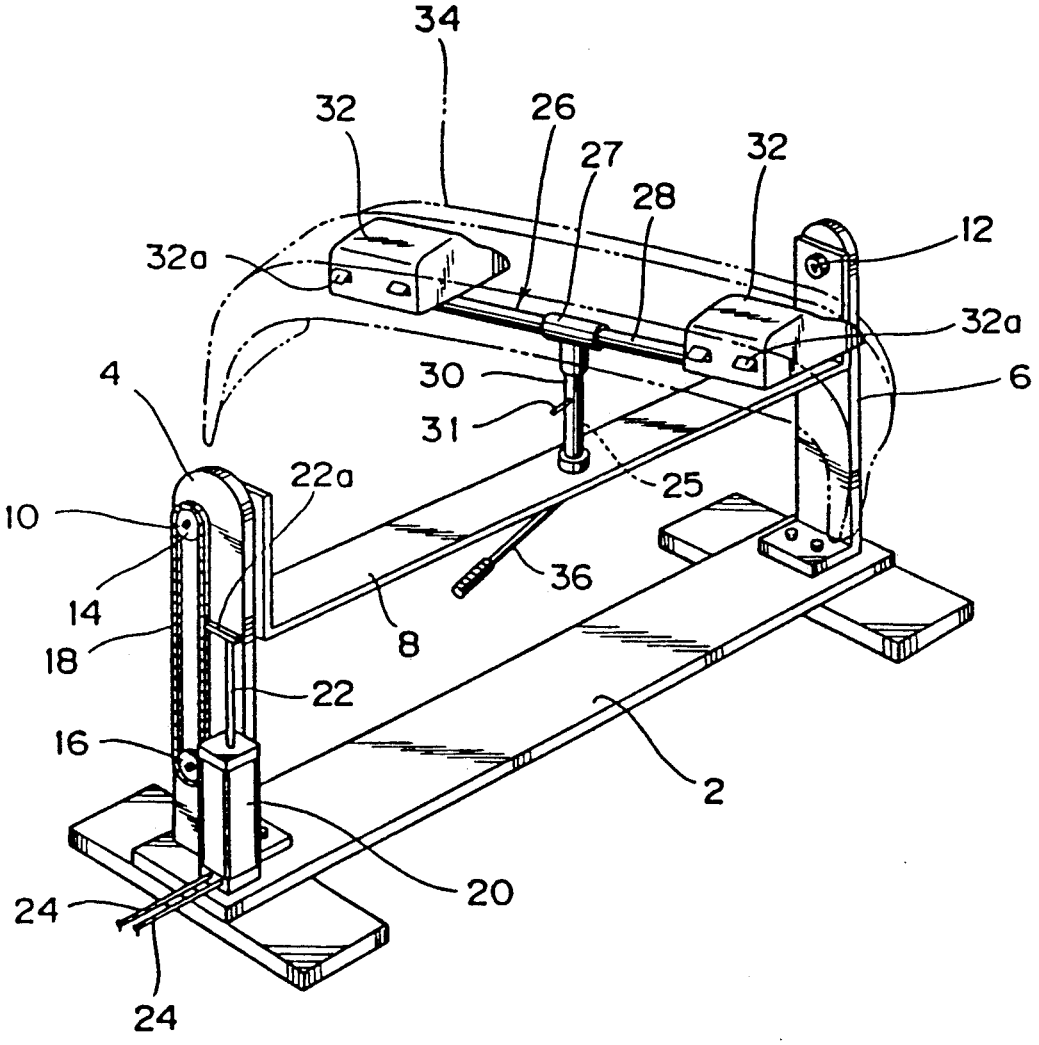
FIG. 1 is a perspective view of a work holding apparatus according to an embodiment of the present invention showing a work holding member rotated by a predetermined angle in a horizontal plane.

Referring to FIG. 1, there is shown a perspective view of a work holding apparatus according to an embodiment of the present invention when the longitudinal opposite end faces of a work to be coated are being coated. A pair of support members 4 and 6 are mounted uprightly on a base 2, and a frame member 8 is mounted for rotation on the support members 4 and 6 by means of rotary shafts 10 and 12. The rotary shaft 10 is fixedly secured to the frame member 8, and a sprocket wheel 14 is fixedly secured to the rotary shaft 10. The rotary shaft 10 is mounted for rotation on the support member 4 by means of a bearing not shown so that the frame member 8 and the sprocket wheel 14 may be rotated in an integral relationship with each other.

Another sprocket wheel 16 is mounted for rotation at a lower end portion of the support member 4. and a chain 18 extends between and around the sprocket wheels 14 and 16. A connecting member 22*a* is provided at an end portion of a piston rod 22 of an air cylinder 20 and secured to the chain 18. Compressed air is supplied into an exhausted from the air cylinder 20 by way of pipe conduits 24.

A work holding member 26 is removably mounted on the frame member 8. The work holding member 26 is constructed such that a horizontal pipe 28 and a support bar 30 are assembled in an integral relationship by means of a T-pipe 27 and a pair of holding pads 32 are secured to the opposite ends of the horizontal pipe 28. A support member 25 in the form of a rod is mounted for rotation substantially at a central portion of the frame member 8 (refer to FIG. 6), and the support bar 30 in the form of a pipe of the work holding member 26 is fitted around the rod-formed support member 25. The rod-formed support member 25 and the pipe-formed support bar 30 are connected to each other by means of a pin 31 to removably mount the work holding member 26 on the frame member 8. A work 34 to be coated which is a bumper for an automobile is mounted in such a manner as shown in phantom in FIG. 1 on the holding pads 32 of the work holding member 26. A lever 36 is provided for rotating the rod-formed support member 25.

Figure 2:
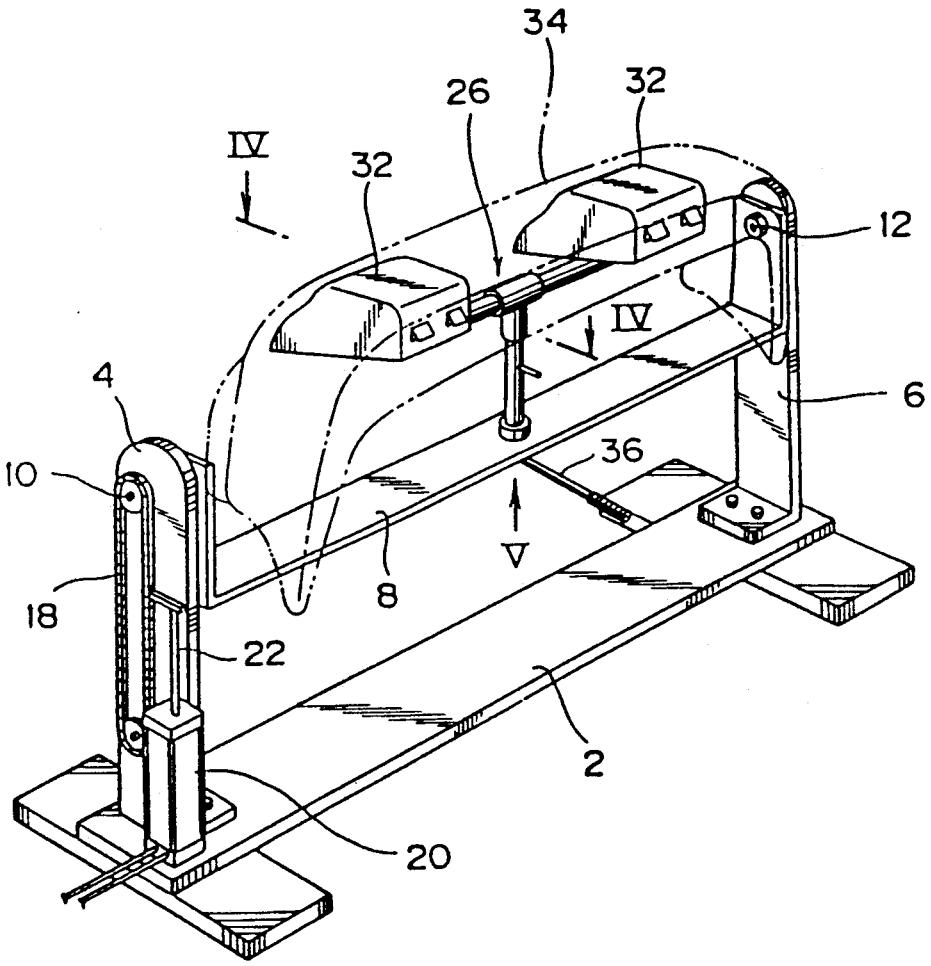
FIG. 2 is a perspective view of the work holding apparatus according to the embodiment of the present invention showing the work holding member directed in the same direction as the longitudinal direction of a frame.

Referring now to FIG. 2, there is shown a perspective view of the work holding apparatus when an upper face and side faces of the work 34 are to be coated. The lever 36 is operated to rotate the work holding member 26 from a position shown in FIG. 1 to another position shown in FIG. 2 in which the longitudinal direction of the work 34 coincides with the longitudinal direction of the frame member 8 in order to coat the upper face and the side faces of the work 34.

Figure 3:
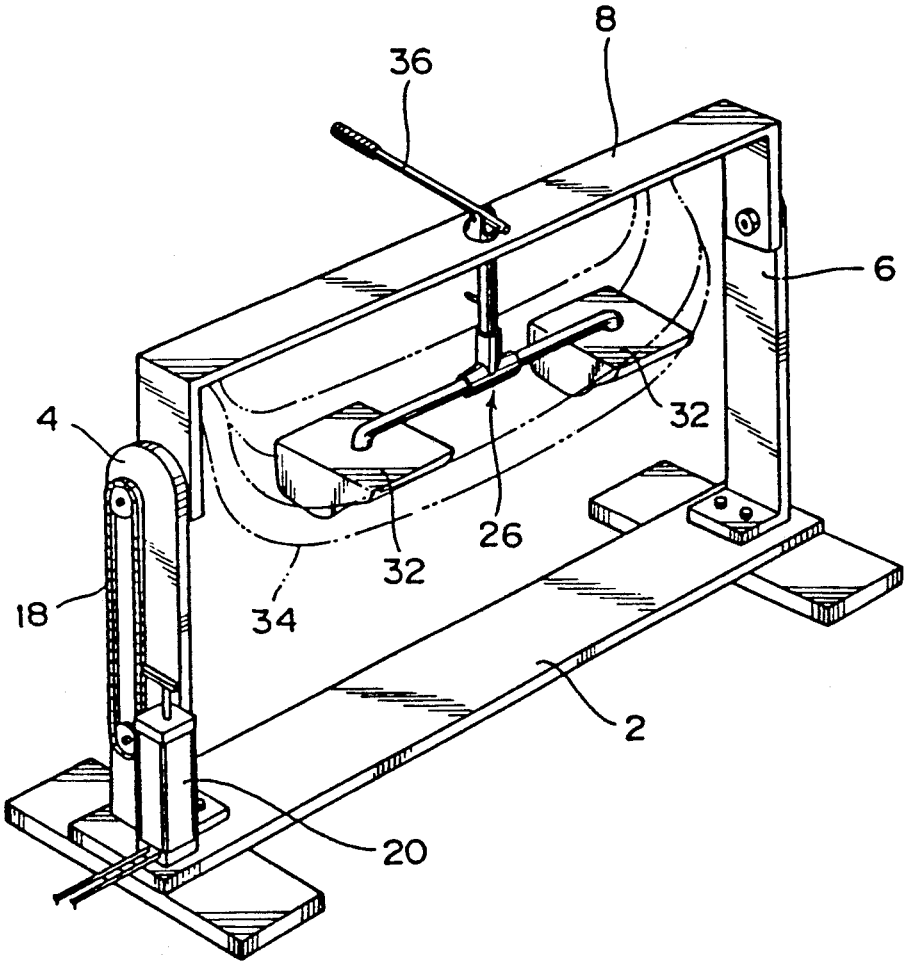
FIG. 3 is a perspective view of the work holding apparatus according to the embodiment of the present invention showing the frame and the work holding member rotated about 180 degrees in the clockwise direction from their positions shown in FIG. 2.

FIG. 3 shows the frame member 8 and the work 34 after rotated about 180 degrees in the clockwise direction from their positions shown in FIG. 2 by driving the air cylinder 20. In the condition shown in FIG. 3, the piston rod 22 of the air cylinder 20 is positioned at its bottom dead center. If the piston rod 22 of the air cylinder 20 is extended from such position, then the frame member 8 and the work 34 start to rotate in the counterclockwise direction, and if the piston rod 22 is further extended past the intermediate position shown in FIG. 2 to a position of the top dead center, a condition similar to the condition shown in FIG. 3 is reached by rotation of the frame member 8 and the work 34 about 360 degrees in the counterclockwise direction from the position shown in FIG. 3. Thus, in the present embodiment, reciprocating movement of the piston rod 22 is converted into rotating movement by means of the chain 18 and the sprocket wheel 14 to alternately rotate the work holding member 26 and the work 34 forwardly and reversely in order to prevent a possible sagging of paint after coating of the work 34. The angular range of rotation of the frame member 8 can be set suitably by a ratio between numbers of teeth of the chain 18 and the sprocket wheel 14.

In the present embodiment, the locations of the rotary shafts 10 and 12 are important, and the rotary shafts 10 and 12 are provided substantially at the center of the width of the work 34 held on the work holding member 26 along a direction perpendicular to the longitudinal direction of the work 34. Consequently, the coating on the work can be dried while being rotated with a minimum radius of rotation, which allows minimization of the spacing of the drying furnace and so forth.

Figure 4:
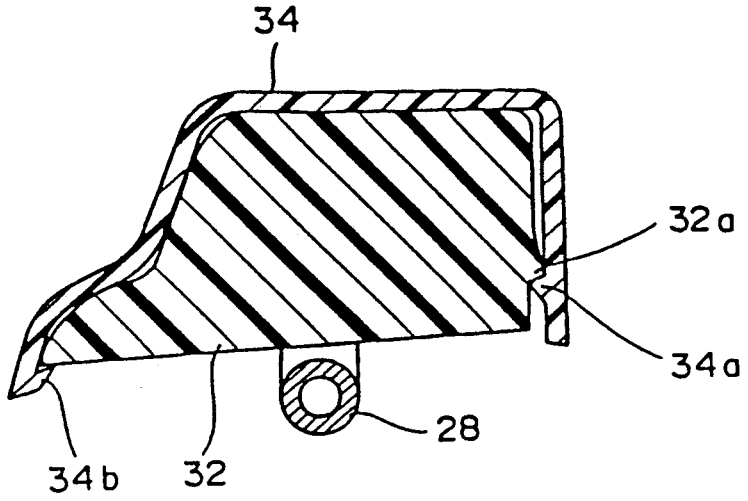
FIG. 4 is an enlarged sectional view taken along line IV—IV of FIG. 2.

Referring now to FIG. 4, there is shown a sectional view taken along line IV—IV of FIG. 4, that is, a sectional view of the work holding apparatus when the work 34 to be coated in the form of a bumper is mounted on the holding pads 32. Each of the pads 32 is formed, for example, from a styrene foam block and has a pair of engaging projections 32*a* formed on a side face thereof as seen in FIG. 1. Each of the holding pads 32 has an outer profile substantially conforming to a sectional shape of the work 34 which has formed thereon a pair of engaging projections 34*a* for engaging with engaging projections 32*a* of the holding pad 32 and another pair of engaging projections 34*b* for engaging with a bottom face of the holding pad 32. Due to the construction, the work 34 is secured firmly to the holding pads 32 and, even if the holding pads 32 are turned, the work 34 will not be let off from the holding pads 32.

A locking mechanism for the lever 36 will be described with reference to FIGS. 5 and 6. As shown in FIG. 6, the rod-formed support member 25 is secured at a lower end thereof to an upper side mounting member 38 while the upper side mounting member 38 and a lower side mounting member 40 are fastened to each other by means of a fastening means 41 with the frame member 8 held therebetween so that the rod-formed support member 25 is mounted for rotation on the frame member 8.

A pair of brackets 42 are secured to the lower side mounting member 40, and a shaft 44 extends between the brackets 42. A coil spring 46 is fitted around the shaft 44 to normally urge the lever 36 such that a locking projection 36*a* provided at an end portion of the lever 36 may be selectively fitted in one of three locking holes 8*a*, 8*b* and 8*c* formed on the frame member 8. Normally, the locking projection 36*a* of the lever 36 is fitted in the central one 8*b* of the three locking holes 8*a*, 8*b* and 8*c* of the frame member 8 so that a work to be coated can be rotated around an axis of rotation of the rotary shafts 10 and 12.

Figure 5:
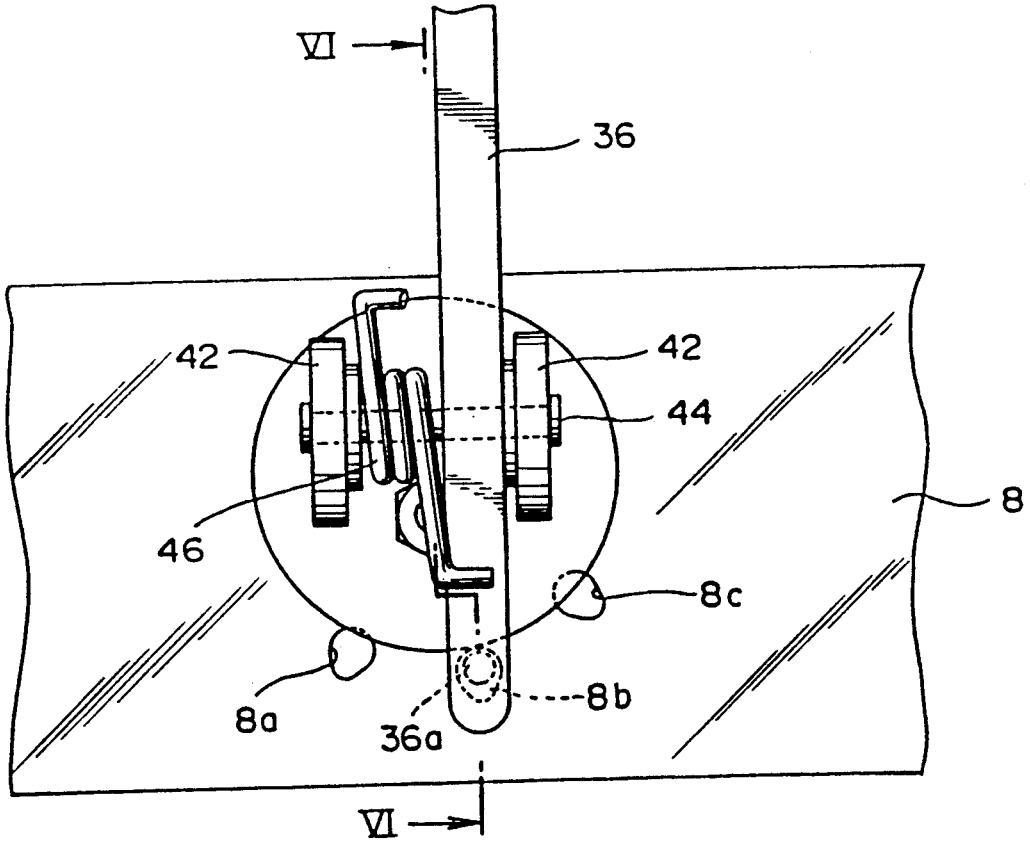
FIG. 5 is an enlarged view taken in the direction indicated by an arrow marked V in FIG. 2.
Figure 6:
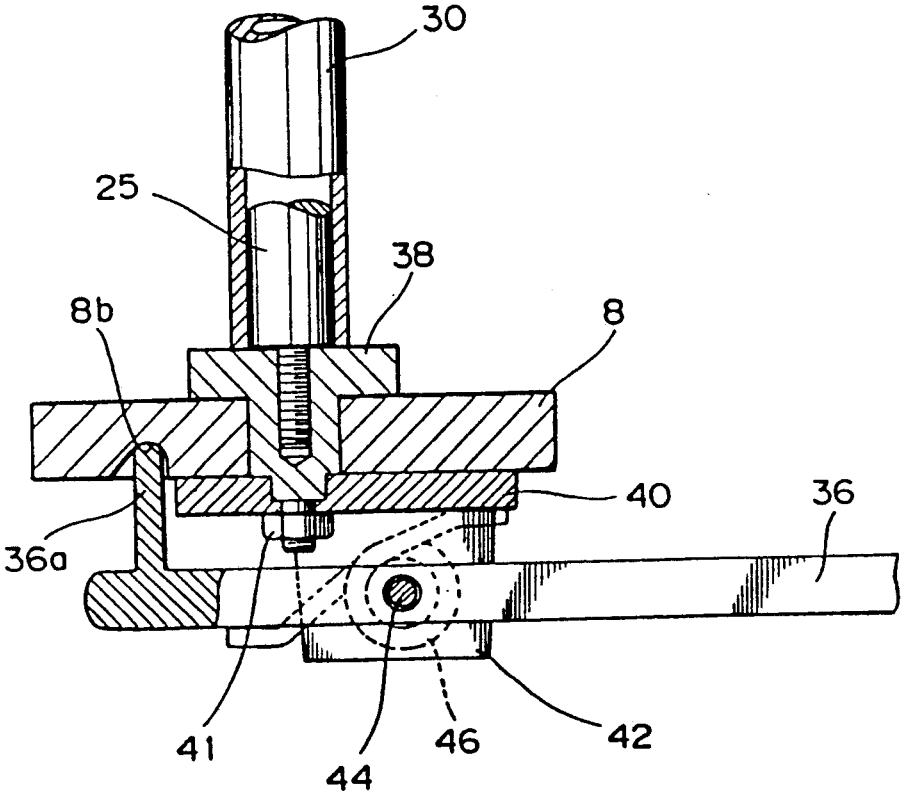
FIG. 6 is a sectional view taken along line VI—VI of FIG. 5.

When the work holding member 26 in such a posture as shown in FIG. 2 is to be rotated horizontally to the posture shown in FIG. 1, the right-hand end of the lever 36 in FIG. 6 is moved upwardly to disengage the locking projection 36*a* from the locking hole 8*b* of the frame member 8, and then while the right-hand end of the lever 36 is kept in the upwardly moved position, the lever 36 is turned leftwardly in FIG. 2, that is, in the clockwise direction (in the counterclockwise direction in FIG. 5) until the locking projection 36*a* thereof is fitted now into the locking hole 8*c* of the frame member 8 shown in FIG. 5, whereafter the lever 36 is released from the hand. As a result, the work holding member 26 can be locked in such a rotated position as shown in FIG. 1 due to the engagement between the locking hole 8*c* of the frame member 8 and the locking projection 36*a* of the lever 36 under the urging force of the coil spring 46.

Figure 7:
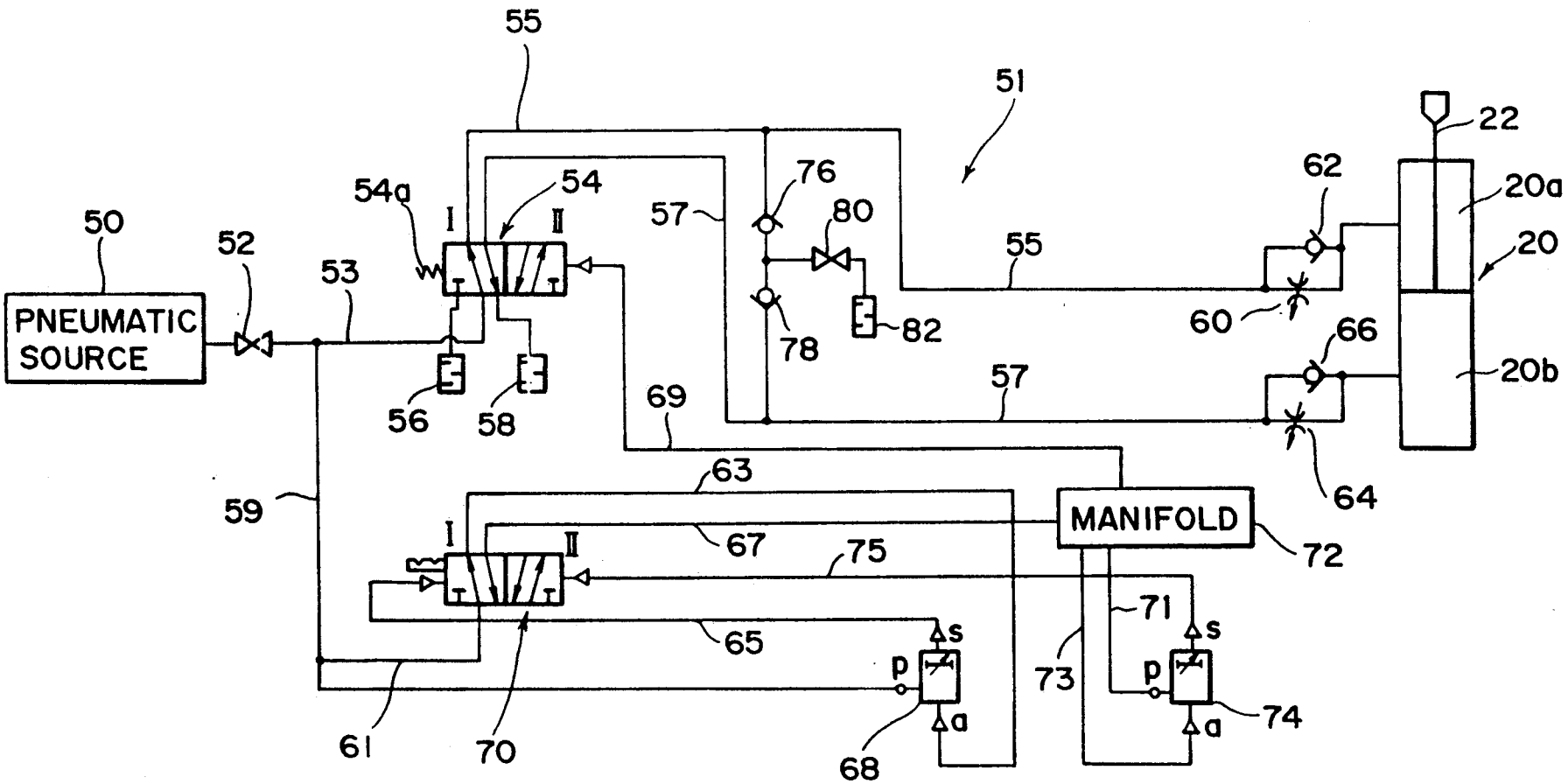
FIG. 7 is a circuit diagram of a control circuit for a driving mechanism.

Subsequently, a control circuit 51 for the air cylinder 20 will be described with reference to FIG. 7. If a ball valve 52 is opened, then compressed air from a pneumatic source 50 is supplied into a 3-port 2-position air valve 54 by way of a pipe line 53. A pair of silencers 56 and 58 for eliminating exhaust noises are connected to the air valve 54. When the air valve 54 is in its position I shown in FIG. 7, compressed air is introduced into a rod side chamber 20*a* of the air cylinder 20 by way of the air valve 54, a pipe line 55 and a restrictor 60 so that the piston rod 22 is contracted. Meanwhile, air in a head side chamber 20*b* of the air cylinder is introduced into the air valve 54 by way of a check valve 66 and a pipe line 57 and then exhausted by way of the silencer 58.

In the meantime, compressed air from the pneumatic source 50 is introduced to a pilot port p of a pneumatic timer 68 by way of a pipe line 59 and also into a 3-port 2-position air valve 70 by way of another pipe line 61. When the air valve 70 is in its position I shown in FIG. 7, compressed air in the pipe line 61 is introduced to an entrance port "a" of the timer 68 by way of the air valve 70 and a pipe line 63, and consequently, after lapse of a predetermined interval of time, a signal pressure is delivered from a signal port s of the timer 68. The signal pressure is introduced to a pilot portion of the air valve 70 by way of a pipe line 65 to change over the air valve 70 to the other position II. Consequently, compressed air in the pipe line 61 is now supplied into a manifold 72 by way of the air valve 70 and a pipe line 67 and then supplied from the manifold 72 to a pilot port of the air valve 54 by way of a pipe line 69 to change over the air valve 54 to the other position II.

After the air valve 54 is changed over to the position II in this manner, compressed air from the pneumatic source 50 is now introduced into a head side chamber 20*b* of the air cylinder 20 by way of the pipe line 53, the air valve 54, the pipe line 57 and a restrictor 64 to extend the piston rod 22. In this instance, air in the rod side chamber 20*a* of the air cylinder 20 is introduced into the air valve 54 by way of a check valve 62 and the pipe line 55 and then exhausted by way of the silencer 56.

Meanwhile, compressed air from the manifold 72 is supplied to a pilot port p of a pneumatically operated timer 74 by way of a pipe line 71 and also to an entrance port "a" of the timer 74 by way of another pipe line 73. Consequently, after lapse of a predetermined interval of time, a signal pressure is delivered from a signal port s of the timer 74. The signal pressure is introduced to a pilot port of the air valve 70 by way of a pipe line 75 to change over the air valve 70 to the position I. Consequently, supply of compressed air to the pilot port of the air valve 54 by way of the pipe line 67, manifold 72 and pipe line 69 is interrupted, and as a result, the air valve 54 is changed over back to the position I by force of a spring 54*a* so that compressed air is now introduced into the rod side chamber 20*a* of the air cylinder 20 and the piston rod 22 is contracted. In this manner, in the air cylinder control circuit of the present embodiment, the piston rod 22 is extended and contracted in accordance with times set by the timers 68 and 74 to circulate the chain 18 alternately in the clockwise and counterclockwise directions, and accordingly, the work holding member 26 can be rotated alternately forwardly and reversely in a predetermined cycle.

Meanwhile, the pipe lines 55 and 57 are connected to a ball valve 80 by way of a pair of check valves 76 and 78, respectively, so that, when the ball valve 80 is opened, air in the two chambers 20*a* and 20*b* of the air cylinder 20 is exhausted by way of a silencer 82. When a work is to be coated, the ball valve 80 is opened to exhaust air from the two chambers 20*a* and 20*b* of the air cylinder 20 to put the air cylinder 20 into a neutral condition, and in this condition, coating is performed.

Thus, a work to be coated can be rotated alternately in the clockwise and counterclockwise directions in a predetermined cycle by controlling supply and exhaust of compressed air into and from the air cylinder 20 by means of the control circuit described above. A time required for one cycle of rotation can be set suitably by means of the timers 68 and 74, and in the case of a bumper for an automobile, for example, one cycle may be set to several tens seconds. Further, while the work is compulsorily dried for about 40 to 50 minutes or so in a drying furnace after completion of coating, it is sufficient to make rotational movement of the work for about initial 20 minutes in which a sagging of paint may possibly take place.

While in the embodiment described above sprocket wheels and a chain are adopted as part of driving means, the present invention is not limited to those elements, and for example, some other motion transmitting means such as, for example, a timing belt and a pulley can be adopted.

Figure 8:
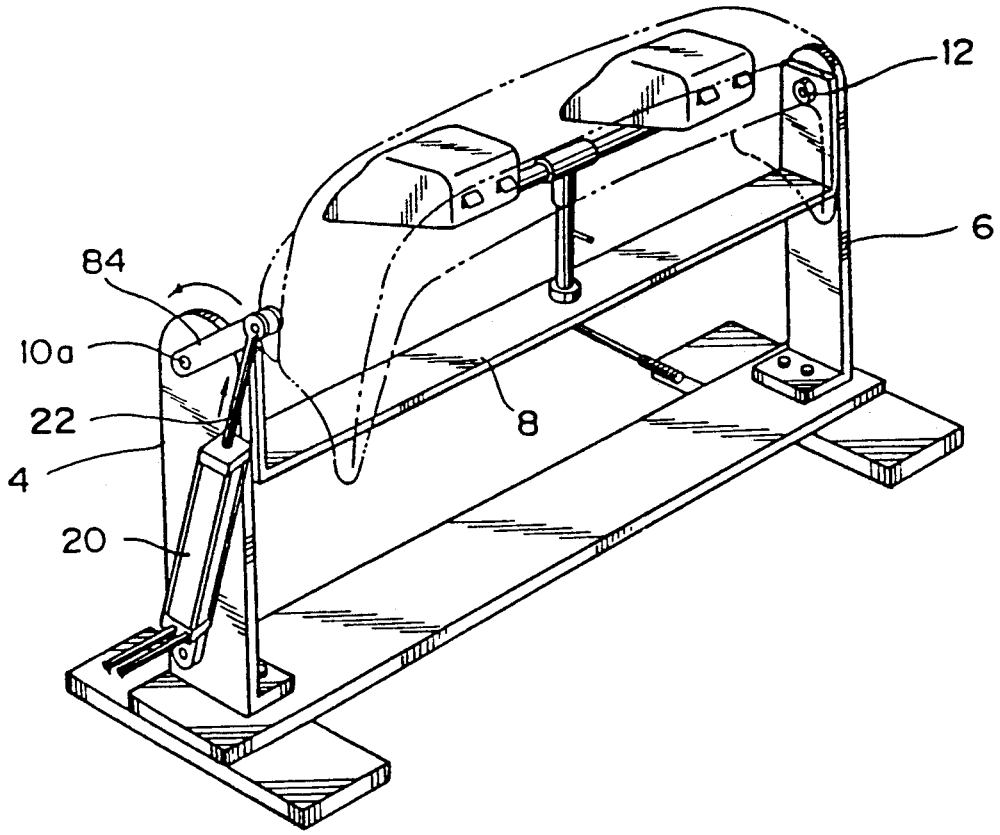
FIG. 8 is a perspective view showing another embodiment of the present invention.

Further, the driving means need not adopt such a string element as a chain or a timing belt described above but may adopt such structure wherein a rotary shaft 10*a* is directly driven to rotate as shown in FIG. 8. In particular, referring to FIG. 8, the rotary shaft 10*a* is supported for rotation on the support member 4 and is secured at an end thereof to the frame member 8 and at the other end thereof to an inner end of a rotary arm 84. The rotary arm 84 is connected at the other or outer end thereof for mutual rotation to an end portion of the piston rod 22. In this embodiment, the control circuit 51 shown in FIG. 7 may be employed as controlling means for the air cylinder 20. Where such structure is employed, when the piston rod 22 of the air cylinder 20 is extended and contracted repetitively, the rotary arm 84 and hence the frame member 8 are successively rotated in only one direction, that is, in the counterclockwise direction in FIG. 8.

As described in detail so far, according to the present invention, since the direction of the gravity acting on a coated film of paint is changed continuously by rotating a work for a predetermined period of time after coating, a possible sagging of paint can be prevented effectively, and consequently, a smooth coated surface having a good appearance can be obtained. Further, since the rotary shafts are located suitably, a work can be dried while being rotated with a minimum radius of rotation, and consequently, a space for a drying furnace and so forth can be reduced.

What is claimed is:

1. A work holding apparatus for holding a work thereon while rotating the same after completion of coating, the work including an elongate intermediate portion and end portions extending generally perpendicularly to the intermediate portion, comprising:

a first support member;

a frame mounted for rotation about a horizontal axis on said first support member, said frame having a generally C-shaped profile;

a second support member mounted uprightly substantially at a central portion of said frame so that a generally E-shaped profile is formed with said C-shaped frame;

a work holding member removably mounted on said second support member;

driving means for automatically rotating said frame;

wherein the axis of rotation of said frame is adapted to be provided substantially at a center of the length of the work in a direction perpendicular to the longitudinal direction thereof held on said work holding member, and wherein said work holding member is adapted to accommodate the work such that a longitudinal outer face of the intermediate portion thereof is positioned remote from said frame and the end portions extend towards said frame; and wherein said second support member is rotatably mounted substantially at a central portion of said frame in the longitudinal direction for rotation about said frame, and further comprising locking means for locking said second support member at one of a plurality of predetermined angular positions as said second support member is rotated with respect to said frame.

2. A work holding apparatus according to claim 1, wherein said driving means continuously rotates said frame in one direction.

3. A work holding apparatus according to claim 1, wherein said driving means rotates said frame alternately forwardly and reversely within a predetermined angular range, and further comprising control means for controlling said driving means so that said frame may be rotated alternately forwardly and reversely in a predetermined cycle.

4. A work holding apparatus for holding a work thereon while rotating the same after completion of coating, comprising:

a first support member;

a frame mounted for rotation on said first support member;

a second support member mounted uprightly substantially at a central portion of said frame;

a work holding member removably mounted on said second support member;

an axis of rotation of said frame being provided substantially at a center of a width of a work held on said work holding member along a direction perpendicular to the longitudinal direction of the work; and driving means for rotating said frame, wherein said driving means includes a first sprocket wheel mounted for integral rotation on said frame, a second sprocket wheel disposed in a spaced relationship from said first sprocket wheel, a chain extending between and around said first and second sprocket wheels, and air cylinder means having a piston rod which is directly secured at an end portion of said piston rod to said chain.

* * * * *